US011992111B2

(12) United States Patent
Triulzi et al.

(10) Patent No.: US 11,992,111 B2
(45) Date of Patent: May 28, 2024

(54) LOW-PROFILE HAIR CLIP

(71) Applicants: Bianca Triulzi, Waiblingen (DE); Thomas Traub, Stuttgart (DE)

(72) Inventors: Bianca Triulzi, Waiblingen (DE); Thomas Traub, Stuttgart (DE)

( * ) Notice: Subject to any disclaimer, the term of this patent is extended or adjusted under 35 U.S.C. 154(b) by 365 days.

(21) Appl. No.: 16/950,620

(22) Filed: Nov. 17, 2020

(65) Prior Publication Data

US 2021/0169194 A1 Jun. 10, 2021

Related U.S. Application Data

(63) Continuation of application No. PCT/EP2019/062704, filed on May 16, 2019.

(30) Foreign Application Priority Data

May 17, 2018 (DE) ..... 10 2018 111 910.0

(51) Int. Cl.
*A45D 8/20* (2006.01)

(52) U.S. Cl.
CPC ..... *A45D 8/20* (2013.01)

(58) Field of Classification Search
CPC ..... A45D 8/20; A45D 8/30; A45D 8/22
See application file for complete search history.

(56) References Cited

U.S. PATENT DOCUMENTS 2,712,319 A 7/1955 Roitner
D179,923 S 3/1957 Solomon
5,697,388 A 12/1997 Chang
(Continued)

FOREIGN PATENT DOCUMENTS

CN 204763968 U 11/2015
DE 29600643 U1 3/1996
(Continued)

OTHER PUBLICATIONS

Amazon, Large Hair Claw Clip, posted Sep. 28, 2017, [visited Feb. 5, 2021]. Internet, <URL: https://www.amazon.co.uk/Large-Hair-Claw-Clamp-Accessory/dp/B076133J83/ref> (Year: 2017).
(Continued)

*Primary Examiner* — Rachel R Steitz
*Assistant Examiner* — Brianne E Kalach
(74) *Attorney, Agent, or Firm* — Harness, Dickey & Pierce, P.L.C.

(57) ABSTRACT

A hair clip includes a first clamping body having a first base portion and a first clamping portion, a second clamping body having a second base portion and a second clamping portion, and a joint by which the first base portion and the second base portion are coupled to one another along a swivel axis. An elastic element forces the first clamping portion and the second clamping portion into a combined position. A first actuator is arranged on the first base portion for moving the first clamping portion relative to the second clamping portion from the combined position into a spread position. Further, the first base portion includes a receptacle for receiving an element of the first actuator so that the first actuator is movable through the receptacle relative to the first base portion from a first position into a second position relative to the first base portion.

20 Claims, 14 Drawing Sheets

(56) References Cited

U.S. PATENT DOCUMENTS

| | | | | |
|---|---|---|---|---|
| 5,842,485 | A | 12/1998 | Potut | |
| D414,583 | S | 9/1999 | Yasuda | |
| D415,591 | S | 10/1999 | Knudsen | |
| D449,132 | S | 10/2001 | Potut | |
| D540,980 | S | 4/2007 | Williams | |
| D583,991 | S | 12/2008 | Pichon | |
| D627,099 | S | 11/2010 | Tu | |
| D700,740 | S | 3/2014 | Cheung | |
| D712,093 | S | 8/2014 | Hsu | |
| D756,572 | S | 5/2016 | Baker | |
| D814,112 | S | 3/2018 | Hsu | |
| 10,051,937 | B1 * | 8/2018 | Wenzel | A45D 8/20 |
| D829,990 | S | 10/2018 | Hsu | |
| 2004/0226574 | A1 | 11/2004 | Winn et al. | |
| 2008/0156342 | A1 * | 7/2008 | Chininis | A45D 8/20 132/277 |
| 2008/0216861 | A1 | 9/2008 | Shyu | |
| 2010/0242987 | A1 | 9/2010 | Washington | |

FOREIGN PATENT DOCUMENTS

| | | | |
|---|---|---|---|
| DE | 202013100225 | U1 | 2/2013 |
| DE | 202014105601 | U1 | 3/2015 |
| DE | 202017103753 | U1 | 7/2017 |
| EM | 002365304-0002 | | 12/2013 |
| EP | 1982612 | A1 | 10/2008 |
| ES | 225741 | U | 3/1977 |
| GB | 2064100 | A | 3/1997 |
| WO | DO46948-001 | | 2/1999 |

OTHER PUBLICATIONS

English translation of Chinese Office Action issued in corresponding CN Application No. 201980032504.2 on Sep. 15, 2023.

* cited by examiner

- PRIOR ART -

- PRIOR ART -

LOW-PROFILE HAIR CLIP

CROSS-REFERENCE TO RELATED APPLICATIONS

This application is a continuation of PCT International Application PCT/EP2019/062704 filed May 16, 2019, which claims priority to German Application No. 10 2018 111 910.0 filed May 17, 2018. The entire disclosures of the applications referenced above are incorporated by reference.

FIELD

The present disclosure relates to a hair clip.

BACKGROUND

Hair clips of the related art are used to hold hair, especially medium to long hair, to fix it to the head or to hold it together to form a ponytail. Often, using such hair clip, hair can be pushed up from the neck and clamped to the back of the head. An example of such a hair clip is shown, for instance, in DE 20 2017 103 753 U1.

DE 20 2017 103 753 U1 shows a hair clip formed by two clamping bodies. The clamping bodies are connected to each other via a joint and are mounted so as to be movable about a swivel axis defined by the joint. The swivel axis divides the clamping bodies into a clamping portion and a pressure portion. An elastic element presses the clamping portions together with a clamping force. Applying pressure to the pressure portions will spread the clamping portions apart, and the clip can be placed in the hair.

Hair clips of this type can be handled easily, especially with one hand, and can be placed precisely in the hair. However, the disadvantage is that the pressure portions for spreading the clip protrude from the enclosed hair and are therefore conspicuously visible. The protruding pressure portions not only have a strong influence on the hairstyle, but also fundamentally limit the design options of the hairstyle. In addition, the protruding pressure portions are susceptible to getting caught on clothing or other objects or otherwise become entangled. Using the hair clip with caps, hats or helmets is therefore severely restricted or even impossible.

Alternatively, hair clips without protruding pressure portions are known. EP 1 982 612 A1, for example, shows a hair clip in which two clamping bodies are connected to each other at one base side, so that when the clip is placed in the hair, the base sides will rest against the hair without protruding. However, the disadvantage here is the elaborate mechanism with a torsion and a pressure spring by which the clip is attached to the hair. Since the mechanism is designed in such a way that the clamping bodies are pressed apart in the normal state and are only fixed when placed, it is difficult to readjust the clip after placement. In addition, the clip does not have the clamping force of a clip described above when fastened, so that the clip is less stable and must be readjusted by hand more often.

SUMMARY

It is an object to provide a hair clip which avoids the above mentioned disadvantages. Further, it is an object to provide a hair clip that provides a stable hold when worn and which is flexible, not bulky, and easy to use one-handed. Yet further, it is an object to provide a hair clip that is inexpensive and has a simple structure.

According to one aspect of the present disclosure, there is provided a hair clip comprising: a first clamping body having a first base portion and a first clamping portion, a second clamping body having a second base portion and a second clamping portion, a joint by which the first base portion and the second base portion are coupled to one another along a swivel axis, so that the first clamping portion and the second clamping portion are arranged movable relative to one another about the swivel axis, an elastic element configured to force the first clamping portion and the second clamping portion into a combined position, and a first actuator arranged on the first base portion for moving the first clamping portion relative to the second clamping portion from the combined position into a spread position, wherein the first base portion further comprises a receptacle for receiving an element of the first actuator so that the actuator is movable through the receptacle relative to the first base portion from a first position to a second position relative to the first base portion.

The hair clip is thus based on the principle of a conventional hair clip, in which hair can be clamped between two pretensioned clamping portions. A pressure portion, which corresponds here to the at least one actuator, can be used to spread the clamping portions apart and to place the clip in the hair.

However, according to the present disclosure, the at least one actuator is not rigidly fixed to one of the clamping bodies as in a conventional hair clip, but is arranged on the clamping body movable relative thereto to assume at least two positions relative to the base portion of the clamping body. In particular, the at least one actuator can be moved back and forth between the first position and the second position.

In the first position, the actuator protrudes from the clamping portion as in a conventional hair clip, so that a force can be exerted on the clamping body via the actuator to spread the clamping portions apart against a clamping force. The spread clip can be placed in the hair and fixed by releasing the actuator.

After the clip has been applied, the actuator can be moved into the second position, in which it no longer protrudes from the clamping portions and the hair, but preferably rests within the clamped hair, especially while being recessed in it. Thus, while wearing the hair clip, no actuator protrudes beyond the clip and from the hair, and the clip is less bulky and less noticeable within the hair. The clamping bodies can lie smoothly on the combined hair and thus do not hinder the wearing of headgear. This also reduces the risk of the clip accidentally getting caught.

The at least one actuator can be brought back into the first position at any time, preferably by a simple hand movement, allowing the clip to be operated as usual. Therefore, the hair clip can be operated easily and with one hand, just like a conventional hair clip. Furthermore, the hair clip can be placed precisely in the hair and can be easily adjusted at any time.

In a further refinement, the hair clip is configured to clamp hair between the first clamping portion and the second clamping portion, wherein the first actuator is configured to fix the hair, in particular to be recessed into the hair, in the second position, when hair is clamped between the first clamping portion and the second clamping portion.

According to this refinement, the actuator will fix the clamped hair, when in the second position. Preferably, the actuator is recessed into the clamped hair. Thus, the actuator is not only positioned in a safe manner, but also stabilizes the hairstyle and the hair clip in the hair. The refinement thus contributes to a further stabilization of the hairstyle and a long-lasting fit of the clip.

In a further refinement, the swivel axis and a point on a side of the first clamping portion facing away from the first base portion defines a first clamping plane, wherein, in the first position, a larger part of the first actuator or the entire first actuator is located on a side of the first clamping plane facing away from the second clamping portion and, in the second position, a larger part of the first actuator or the entire first actuator is located on a side of the first clamping plane facing the second clamping portion.

According to this refinement, the actuator is thus "extended" as far as possible in the first position, so that there is a large lever of the actuator relative to the first clamping body. Thereby, the clip can be operated easily against the clamping force. In the second position, on the other hand, the actuator is hidden as far as possible and almost completely within the "inside" of the clip, so that the actuator does not protrude significantly or not at all from the hair.

In a further refinement, the receptacle is configured to guide the first actuator from the first position into the second position.

According to this refinement, the actuator is arranged in a receptacle on the first base portion so that it can move between the first position and the second position. The actuator can thus be easily and permanently attached to the hair clip.

In an example refinement, the receptacle is formed such that the first actuator can be at least partially inserted through the receptacle in order to be moved back and forth between the first position and the second position.

According to this refinement, the actuator and the corresponding receptacle can be of a simple design. The refinement thus contributes to a simple and cost-effective production of the hair clip.

In another example refinement, the receptacle is formed from a separate sleeve.

According to this refinement, the mechanical load applied to the clamping body by the actuator can be absorbed by the sleeve. Low wear is achieved thereby. In addition, the sleeve allows precise guidance of the actuator and thus improves the handling of the hair clip.

In a further refinement, the first actuator has a first stop, which, in the second position, rests against the first base portion.

In this refinement, the first actuator has at least on one side a termination element such as a cap, which prevents the first actuator from being moved beyond the first position.

In a further example refinement, the first actuator also has a second stop which, in the first position, rests against the first base portion.

In this refinement, termination elements on both sides of the actuator prevent that the clip slips out of the hair. This refinement thus further contributes to better handling of the clip and allows the actuator to be held permanently on the hair clip despite the variable positions it can assume. Similarly, the termination elements also indicate to a user, whether the respective first or second position has been completely assumed.

In a further refinement, the first actuator has means such as a notch or clamping groove, by which the actuator can be fixed in a self-retaining manner in the first position.

According to this refinement, the actuator can thus initially be fixed in the first position, in which it is used as pressure portion for spreading the clamping portions apart. Thereby, when the clip is applied, the actuator cannot slip and the clip can be handled safely.

In a further refinement, the first actuator has a curvature to increase an opening angle between the first clamping portion and the second clamping portion, when the first actuator is actuated.

According to this refinement, the actuator is designed in an arc to increase the distance that causes the lift of the clamping portions to each other. Thereby, the clip can be opened further than with a straight actuator, and thus the clip can be placed in the hair more easily.

In a further refinement, the first actuator has an element which can be inserted through a correspondingly shaped receptacle in the first base portion. The element can be shaped like a pin, for example.

According to this refinement, the first actuator can be inserted into the hair like a hairpin, making it particularly easy to move the actuator from the first position to the second position and to recess the actuator into the hair. The corresponding receptacles can also be easily formed, so that several receptacles can be provided on a base portion, and the actuator can thus be placed at different locations. This refinement thus further contributes to simple and cost-effective production as well as variable design and easy handling.

In an example refinement, the first actuator has at least one further element which can be inserted through a further correspondingly shaped receptacle in the first base portion, the one element and the at least one further element being connected to one another via a bracket.

According to this refinement, the actuator thus comprises two insertable elements which are combined into a U-shaped element via a bracket. The actuator thus corresponds in its form to a staple with two pins connected by a bracket. The insertable elements can be pushed into the base portion via receptacles that are spaced apart. The bracket on the one hand ensures greater stability of the actuator and on the other hand serves as a stop so that the elements cannot be pushed beyond the receptacles. Overall, the use of several parallel elements connected by a bracket increases the effective area for actuating the actuator, thus simplifying handling. At the same time, the plurality of elements that can be recessed into the hair improves the hold of the clip.

In another refinement, the second clamping body has a second actuator located on the second base portion for moving the second clamping portion relative to the first clamping portion, and the second actuator is arranged on the second base portion movable relative thereto so that the second actuator can assume a first position and a second position relative to the second base portion.

According to this refinement, both clamping bodies comprise an actuator to simplify handling of the clip. The actuators can be actuated against each other simultaneously making it particularly easy to spread the two clamping portions apart. The actuators may be operated by one hand.

In an example refinement, the first clamping body and the second clamping body are formed such that the first actuator and the second actuator, when in the second position, do not touch each other, in particular are moved past each other.

According to this refinement, the actuators are offset from each other so that they rest against or are recessed into the hair at offset positions. Thereby, the stability provided by the hair clip can be further increased, as the actuators rest against or engage with the hair at various positions.

In a further refinement, the second clamping body is identical in shape to the first clamping body.

According to this refinement, the first clamping body and the second clamping body have the same form. This allows a cost-effective production of the hair clip, as only one template or tool is needed to produce the first clamping body and the second clamping body. Especially, if the clamping body is manufactured by injection molding, the manufacturing costs can be reduced advantageously.

It goes without saying that the features mentioned above and those to be explained below can be used not only in the combination indicated in each case, but also in other combinations or on their own, without leaving the scope of the present invention.

BRIEF DESCRIPTION OF THE DRAWINGS

Embodiments of the invention are shown in the drawings and are explained in more detail in the following description.

DETAILED DESCRIPTION

Before describing the embodiments of the hair clip below with reference to FIGS. 3 to 11, a conventional hair clip according to the prior art will be described first.

Figure 1:
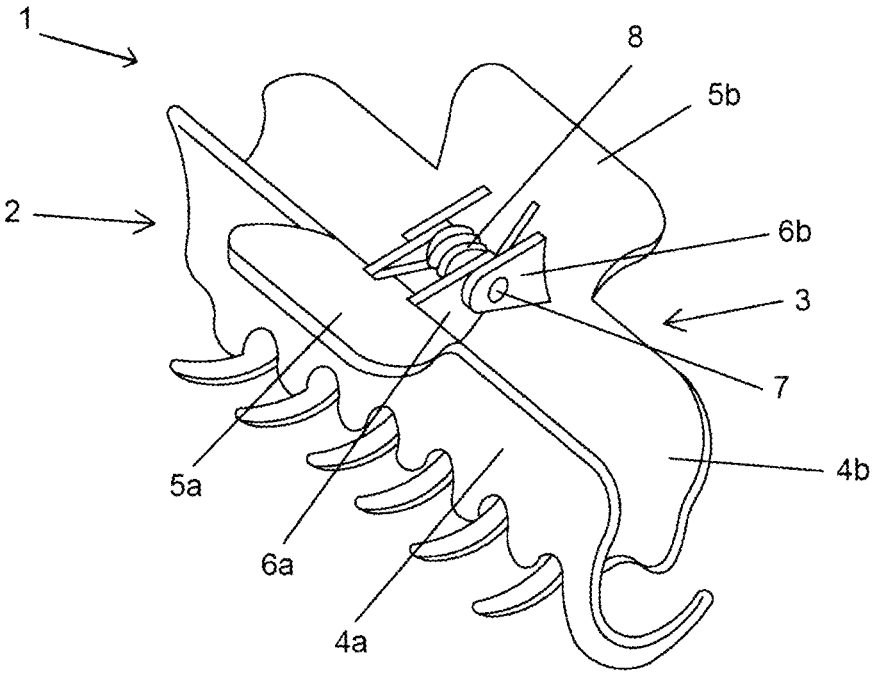
FIG. 1 is a perspective view of a hair clip according to the prior art.

FIG. 1 shows a conventional hair clip according to the prior art. The hair clip 1 has two clamping bodies 2, 3, each of which is divided into a clamping portion 4*a*, 4*b* and a pressure portion 5*a*, 5*b*. At the transitions between the clamping portions 4*a*, 4*b* and the pressure portions 5*a*, 5*b* is a hinge portion 6*a*, 6*b* with sectional barrels. A common hinge pin 7, which is inserted through the sectional barrels of the hinge portions 6*a*, 6*b*, connects the first clamping body 2 and the second clamping body 3 with each other and a coil spring 8 presses the two clamping portions 4*a*, 4*b* together with a clamping force. By applying pressure on the pressure portions 5*a*, 5*b*, the clamping portions 4*a*, 4*b* can be spread apart to place the clip in the hair.

Figure 2:
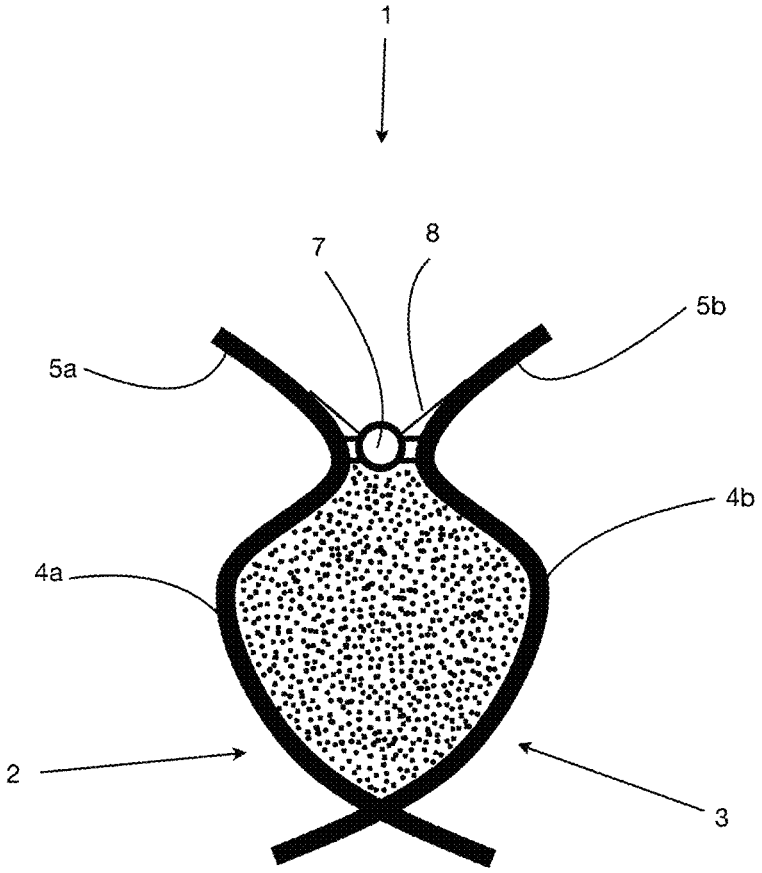
FIG. 2 a side view of a hair clip according to the prior art.

FIG. 2 shows a side view of the conventional hair clip when clipped to the hair. The clamping portions 4*a*, 4*b* enclose a certain amount of hair and hold it together. FIG. 2 shows that the amount of hair is essentially held together only by the clamping force of the coil spring, so that the hair clip can easily slip in the direction of the hair. The fit and wearing comfort can be negatively affected thereby. In addition, the fixed pressure portions 5*a*, 5*b* are constantly and conspicuously visible and thus have a strong influence on the hairstyle.

In view of the disadvantages of conventional hair clips, various embodiments of an improved hair clip are described in the following with reference to FIGS. 3 to 11. Identical reference signs describe the same parts in all figures and are not explained in detail for each figure.

Figure 3:
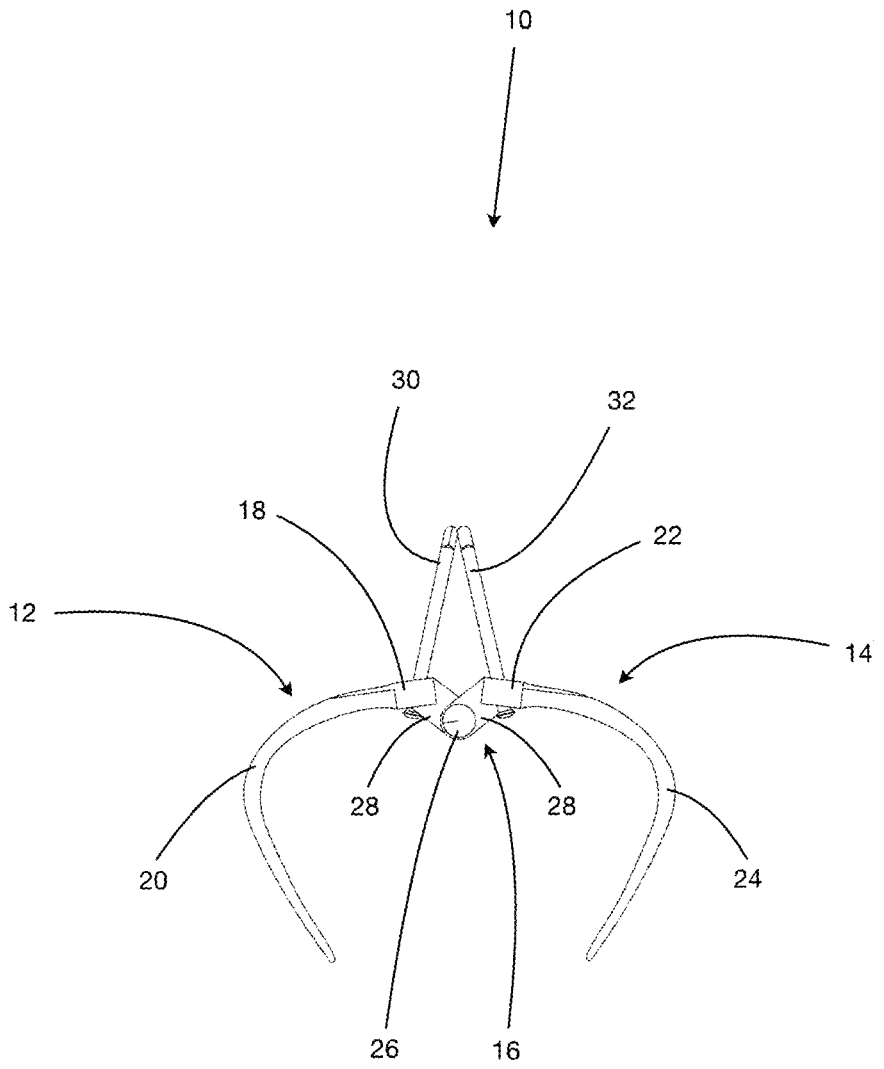
FIG. 3 is a side view of a hair clip according to an embodiment in a spread state.

FIG. 3 shows a first embodiment of a hair clip according to an aspect of the present invention in a side view. The hair clip is here denoted in its entirety with reference numeral 10.

The hair clip 10 has a first clamping body 12 and a second clamping body 14, which are connected to each other by a joint 16. The first clamping body 12 and the second clamping body 14 can be identical. The description of the first clamping body 12 can thus analogously apply to the second clamping body 14. It is understood, however, that in other embodiments the clamping bodies can be of different shapes while still implementing the mechanism according to this disclosure.

The clamping bodies 12, 14 are each divided into a base portion and a clamping portion, i.e. the first clamping body 12 comprises a first base portion 18 and a first clamping portion 20 and the second clamping body 14 comprises a second base portion 22 and a second clamping portion 24. Base portion and clamping portion together form the clamping body as a single piece. As indicated in FIG. 3, the base portion can be defined by a section along one side edge of the clamping portion.

The clamping portions 20, 24 can have different shapes. The hair that is to be held in place are clamped between them. Preferably, the clamping portions 20, 24 are comb-shaped with teeth arranged next to each other, which engage the hair. A shaft, over which the teeth are joined together, preferably forms the respective base portion. The comb-like clamping portions can fix the hair particularly well. However, the invention is not limited to clamping portions formed like this.

The joint 16, which connects the two clamping bodies 12, 14, is arranged at the base portions 18, 22 of the two clamping bodies 12, 14. The two clamping bodies 12, 14 are mounted on the joint 16 so that they can move about a swivel axis 26. As shown here, the joint 16 can be designed as a hinge with two interlocking leafs 28 arranged at the base portion. The leaves 28 have sectional barrels in which a common hinge pin is inserted defining the swivel axis 26 of the hair clip.

The clamping portions 20, 24 can be swiveled around the swivel axis 26 into a combined position or a spread position. In the combined position, the clamping portions 20, 24 lie against each other if there is no hair in between, or if the clamping portions 20, 24 are comb-like, they will interlock. In the spread position, the two clamping portions 20, 24 are separated from each other, at least enough to tuck the hair to be held between the clamping portions 20, 24.

The hair clip 10 is pretensioned by an elastic element and the clamping portions 20, 24 are forced into a combined position thereby. The elastic element can be a torsion spring, for example. A torsion spring is a spring that works by torsion or twisting, i.e. a flexible elastic object that stores mechanical energy when twisted. When the torsion spring is rotated, it generates a torque in the opposite direction, proportional to the angle by which the torsion spring is rotated. Designed as a coil spring, the torsion spring can extend along the swivel axis 26 and compress the clamping portions 20, 24 starting from the base portion 18, 22. It goes without saying that the invention is not limited to a torsion spring, but that other elastic elements are also conceivable, which force the clamping portions 20, 24 into the combined position.

To spread the clamping portions 20, 24, at least one actuator 30 is provided, which is arranged on the first base portion 18. With the help of the actuator, the first clamping portion 20 can be moved relative to the second clamping portion. In other words, a lever can be exerted via the first actuator 30 relative to the swivel axis 26 to press the first clamping portion 20 against a clamping force that holds the clamping portions 20, 24 together. The first actuator 30 is turned outwards for actuating the hair clip 10, i.e. if the swivel axis 26 and a point on a side of the first clamping portion 20 facing away from the first base portion 18 define a first clamping plane, in the first position, a larger part of the first actuator 30 or the entire first actuator 30 is located on a side of the first clamping plane facing away from the second clamping portion 24.

Preferably, the hair clip 10 is symmetrical, so that a corresponding second actuator 32 can be provided on the second base portion 22 of the second clamping body 14, which is designed in the same way as the first actuator 30. The following description of the first actuator 30 can therefore also be applied analogously to the second actuator 32.

The hair clip according to the present disclosure is characterized by the actuator 30 being able to assume two positions on the hair clip 10 compared to a conventional hair clip, i.e. the actuator is arranged on the base portion in a movable manner, so it can be moved from a first position into a second position. The function and effect of a movable actuator 30, or movable actuators 30, 32, is explained in more detail using FIGS. 4 and 5.

Figure 4:
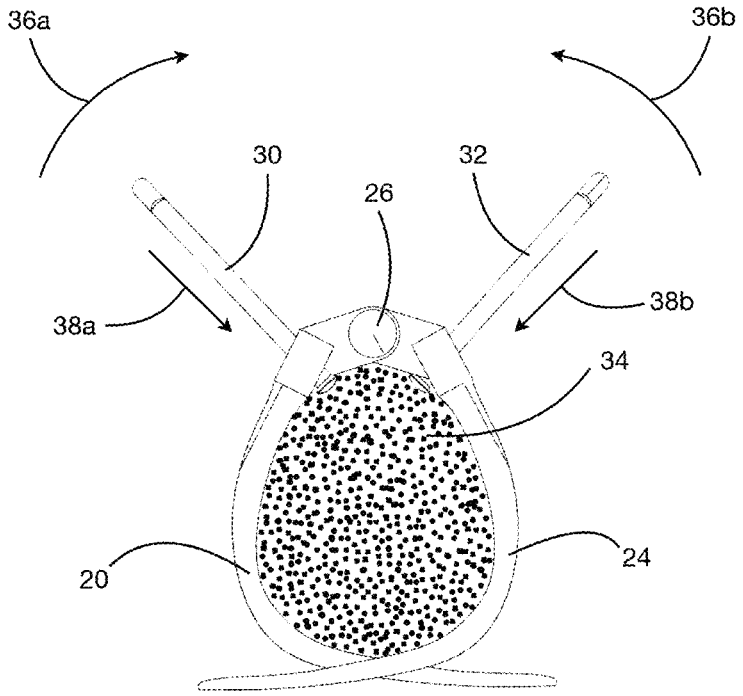
FIG. 4 is a side view of the embodiment according to FIG. 3 in a closed state with actuators being in the first position.
Figure 5:
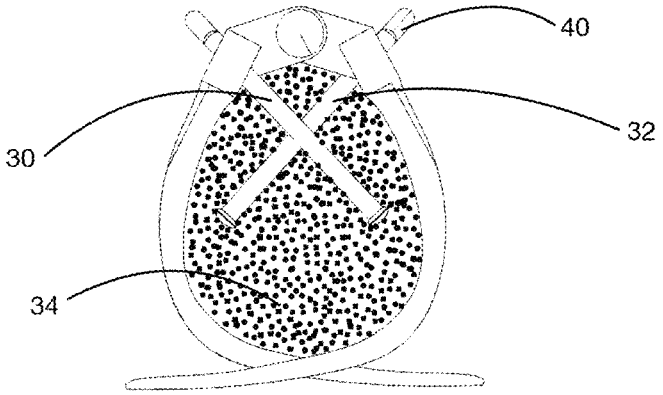
FIG. 5 is a side view of the embodiment according to FIG. 3 in a closed state with actuators being in the second position.

FIG. 4 shows a side view of the embodiment according to FIG. 3 in a closed state with the actuators 30, 32 in the first position. FIG. 5 shows a corresponding side view with the actuators 30, 32 in the second position.

In FIG. 4, the hair clip is fixed in the hair and the hair clip is in a closed state, with the actuators "extended" and serving as pressure portions. In this state, hair 34 is enclosed between the clamping portions 20, 24 defining the "inside" of hair clip 10.

The actuators 30, 32 are in the first position and protrude outwards, i.e. from the inside to the outside of the hair clip. As with a conventional hair clip, the actuators 30, 32 can be used in this position as pressure portions to open the clip. For this purpose, the actuators 30, 32 are each pressed together in a direction of movement 36*a*, 36*b* defined by the swivel axis 26, which causes the clamping portions 20, 24 to expand. Advantageously, this can be done with one hand by squeezing the actuators 30, 32 between the fingers and the palm of one hand. If only one actuator is provided, the fingers or the palm of the hand can alternatively grasp the base portion or the clamping portion of the clamping body where no actuator is provided to perform the corresponding opening movement.

The bearing of the actuator 30, 32 can be designed such that a direction of movement 38*a*, 38*b* of the actuators 30, 32 from the first position into the second position is substantially orthogonal to the direction of movement 36*a*, 36*b* defined by the swivel axis 26. "Substantially orthogonal" in this context means that an angle between the directions of movement 36, 38 is at least between 80° and 100°, in particular between 85° and 95° and especially 90°.

According to the shown embodiment, the actuators 30, 32 are arranged movable in receptacles in the base portions 18, 22. The receptacles are designed to guide the actuators 30, 32 in a direction of movement 38*a*, 38*b*, which is substantially orthogonal to the direction of movement 36*a*, 36*b* defined by the swivel axis 26, i.e. the actuators 30, 32 are arranged such that they can be moved from the first position along the direction of movement 38*a*, 38*b* into the inside of the hair clip 10 to assume the second position. In particular, the actuators 30, 32 are arranged such that in the second position the actuators are recessed in the clamped hair 34. This is shown for clarification in FIG. 5.

FIG. 5 shows the hair clip with "retracted" actuators 30, 32, i.e. with actuators 30, 32 in the second position. The state of the hair clip as shown in FIG. 5 corresponds to the state in which the clip is finally worn in the hair.

In this state, the actuators 30, 32 essentially no longer extend beyond the hair clip 10. Only a termination element 40, which is intended to prevent the actuators 30, 32 from being pushed beyond the second position, may exceed the volume defined by the clamped hair 34. In the second position, the actuators 30, 32 can thus be stuck in the clamped hair 34 to provide greater stability. In particular, the actuators 30, 32, which are stuck into the hair, prevent the hair clip 10 from slipping over time, which might negatively affect the comfort and appearance of the hairstyle.

In an example embodiment, an angle between the actuator and an orthogonal line to the outside of the base portion is between 10° and 30°, in particular 20°. This means that the receptacles on the base portion are designed such that the actuators 30, 32 are guided at an angle to the outside of the base portion in such a way that the actuators 30, 32 retract nearly centrally into the hair in the closed state to achieve optimum stability.

As can be seen in FIG. 5, the actuators 30, 32 can be designed such that they move past each other in the second position, i.e. the first actuator and the second actuator do not touch each other in the second position. By moving the actuators 30, 32 past each other, a particularly high degree of stability can be achieved, since the actuators 30, 32 engage as centrally and deeply as possible in the hair 34. At the same time, the actuators 30, 32 can be designed as long as possible to effectively serve as pressure portions in the first position.

Figure 6:
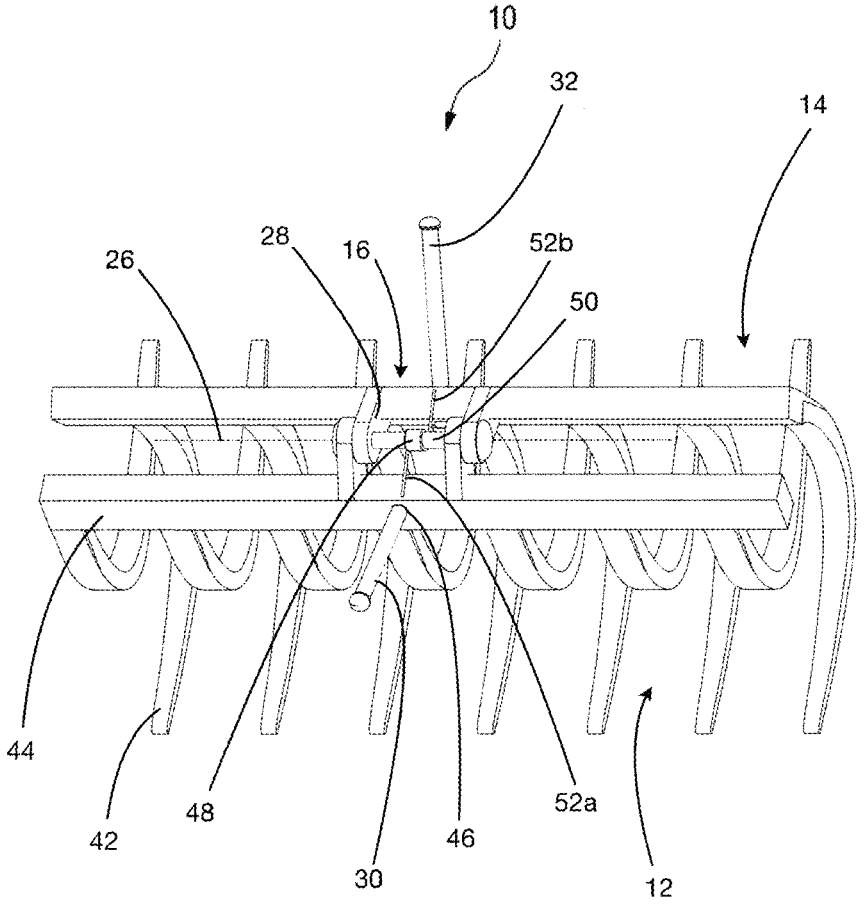
FIG. 6 is a perspective view of an example embodiment of the hair clip.

FIG. 6 shows the previously described embodiment in a perspective view. Here, the clamping bodies 12, 14 are comb-shaped and the clamping portions 20, 24 are formed by a plurality of curved teeth 42 arranged side by side along a shaft 44. The shaft 44 corresponds to a base portion of the clamping body in the sense of the present disclosure. The actuators 30, 32 are arranged on the shaft (base portion) and can be inserted into the shaft through receptacles 46. The actuators 30, 32 according to this embodiment are pin-shaped and the receptacles are correspondingly shaped as holes.

Several receptacles can be provided on the shaft 44, so that further actuators with identical function can be arranged on one shaft 44. A plurality of actuators on one shaft 44 can simplify handling of the clip, as there is a larger contact surface, when the actuators are pressed together. Furthermore, stability of the hairstyle is further increased by the additional fixations.

As shown in FIG. 6, the first clamping body 12 and the second clamping body 14 can be identical, wherein the two identical clamping bodies 12, 14 are offset to each other along the swivel axis 26 in the assembled state due to the adjacent leafs 28 of the joint 16. Thus, the teeth 42 can engage each other so that the actuators 30, 32 of the two clamping bodies 12, 14 do not touch each other in the second position.

According to this embodiment, the clamping bodies 12, 14 are pretensioned in a combined position by a coil spring 48 as an elastic element. The coil spring 48 is wound around a hinge pin 50, with one spring part 52*a*, 52*b* pressing on each of the shafts 44 to bring the clamping portions together with a defined clamping force. It goes without saying that other means are conceivable which force the clamping portions into the combined position.

Figure 7:
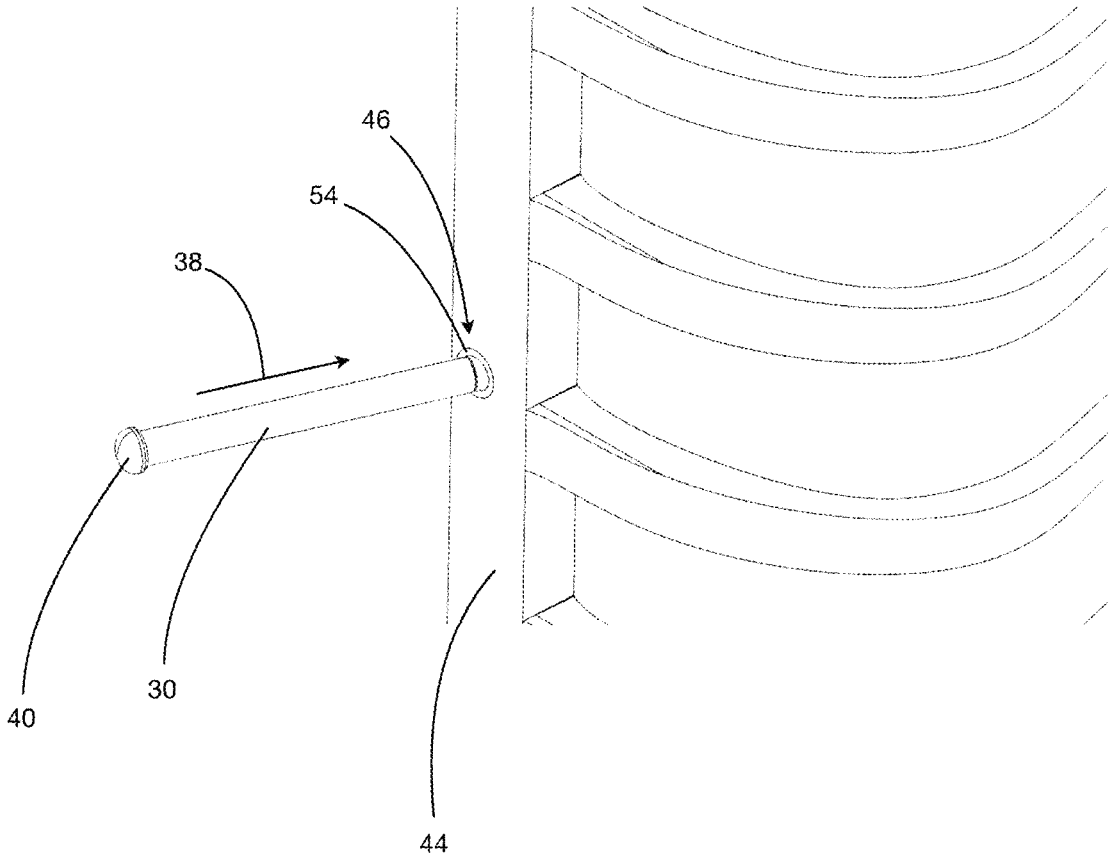
FIG. 7 is an example embodiment of an actuator and a receptacle in a base portion of the hair clip.
Figure 8:
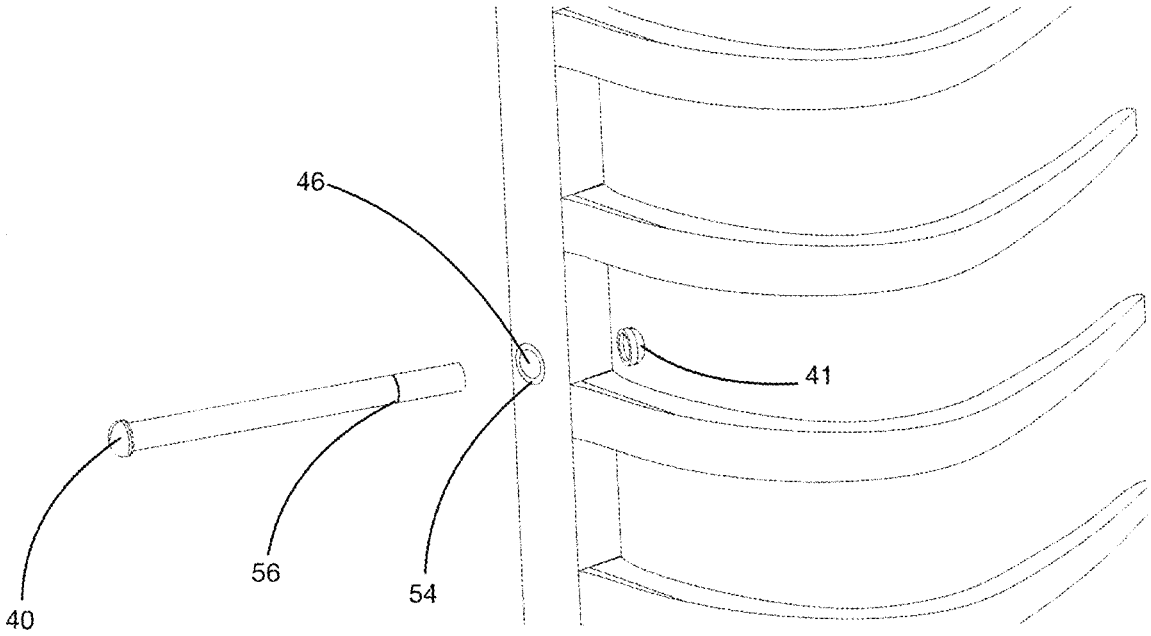
FIG. 8 shows the embodiment according to FIG. 7 in a disassembled state.

FIG. 7 shows a close-up of an embodiment of an actuator and a corresponding receptacle for it. FIG. 8 shows the same view, but with the actuator dismantled into its individual parts.

According to the shown embodiment, the actuator 30 can have a pin-like shape with termination elements 40, 41 at the top and bottom. The termination elements 40, 41 prevent the actuator 30 from sliding out of the receptacle 46. The receptacle 46 can be a sleeve 54, which sits in a recess of the shaft 44. The sleeve 54 can absorb part of the mechanical load acting on the shaft when the clip is opened.

The pin-like form of the actuator and the guiding sleeve both contribute to a light-weight and discreet design of the hair clip, which means that less material is required for the hair clip, an thus enabling resource-saving production.

In addition, the sleeve 54 can guide the actuator 30 when moving from the first position into the second position, providing a defined direction of movement 38 of the actuator, and thus ensuring that the actuator can be optimally placed in the hair.

According to the embodiment shown here, the actuator 30 may further comprise a clamping groove 56. The clamping groove 56 prevents the actuator 30 from moving automatically out of the first position and accidentally slipping into the second position, when being compressed.

It goes without saying that the actuator and receptacles shown here are to be understood as examples only. Other shapes and forms are conceivable, which achieve the same effect of fixing the clip in the hair, while the actuator no longer protrudes beyond the clip. For example, a sword-like form of the actuator, which is held in a slot-like receptacle in the shaft, is conceivable as well. This configuration would have the advantage of a larger surface area, which further improves the stabilization of the hair and makes it easier to press the actuators.

Furthermore, it is conceivable that the actuators are not mounted on the base portion by insertion, but, according to another embodiment, be rotated around the base portion to pivot from a first position into a second position. The actuators could then lie against the hair parallel to the clamping portions and be pressed against the hair, for example by a spring, to provide additional stability. Likewise, the actuators would no longer protrude unfavorably from the clip and could be turned inside the clip.

In addition, a plurality of actuators can be combined independently of the respective bearing to further improve fixation and stabilization. Such an embodiment is shown in FIGS. 9 and 10, for example.

Figure 9:
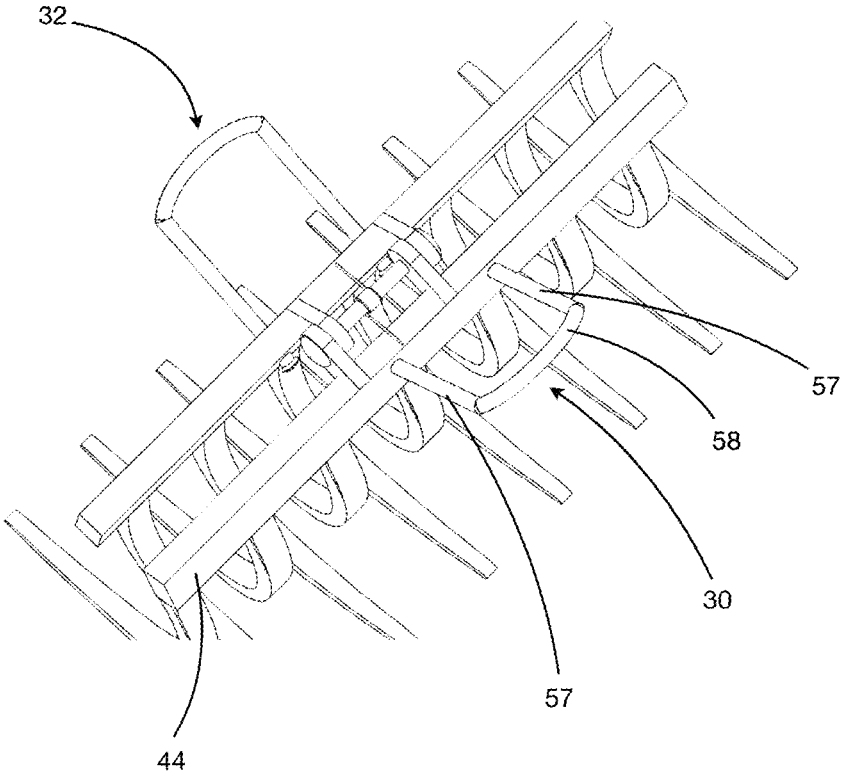
FIG. 9 is a perspective view of another embodiment of a hair clip with pin-like actuators connected by brackets, which are in a first position.
Figure 10:
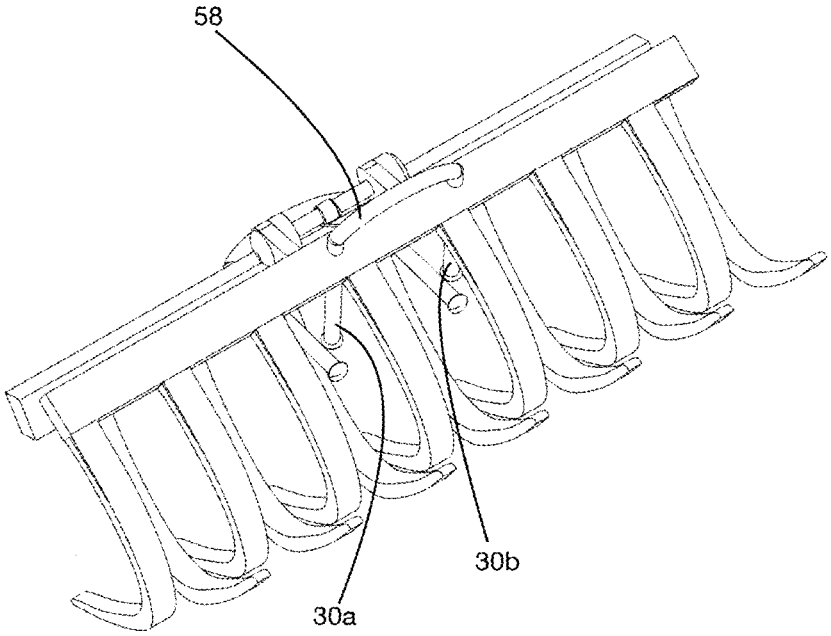
FIG. 10 is a further perspective view of the embodiment according to FIG. 9 with the pin-like actuators being in a second position.

FIGS. 9 and 10 show a hair clip having a similar design to the embodiment shown in FIG. 6, but with actuators 30, 32 comprising several insertable elements 57 connected to each other by a bracket 58. This design has the advantage of enlarging an area that is essential for touching the actuator and for its operation, while the actuator is altogether of slender and light design, and can therefore still be easily recessed into the hair.

It goes without saying that, in addition to the variant with two insertable elements 57 shown here, a plurality of insertable elements 57 can also be grouped together like a comb via one or more brackets 58. As shown in FIG. 10, the combined actuators can be recessed into the inside of the hair clip in the same way as individually insertable actuators. In addition, the bracket 58 serves as a termination element.

Figure 11:
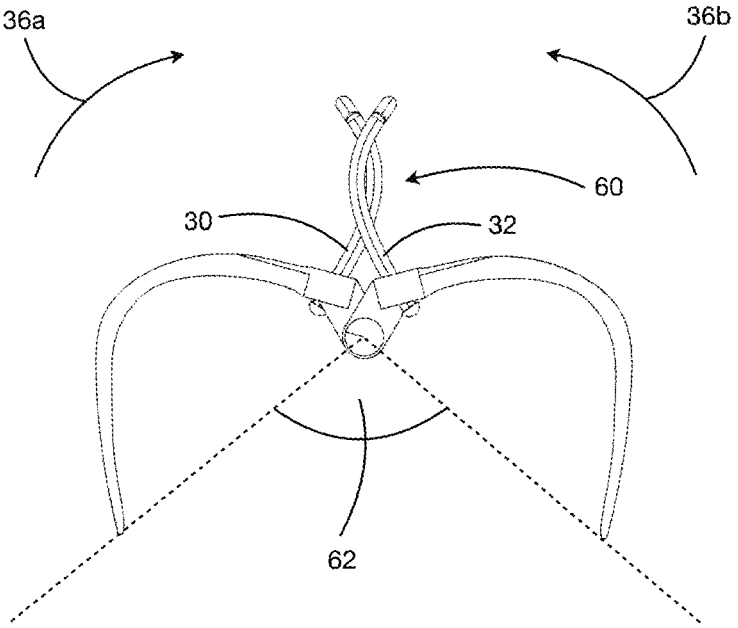
FIG. 11 is a side view of another example embodiment with curved actuators.

FIG. 11 shows a further embodiment, in which the actuators 30, 32 each have a curvature 60. The curvature 60 of the individual actuators 30, 32 results from the fact that the actuators 30, 32 are bent against the respective direction of movement 36*a*, 36*b* defined by the swivel axis 26 to increase a rotation angle between the swivel axis 26 and the tips of the actuators 30, 32. Thereby, an opening angle 62 between the swivel axis and the clamping portions can be increased when the actuators 30, 32 are pressed together, making it easier to place hair inside the clip. Especially, in the case of interlocking clamping portions, the increase in the opening angle is advantageous.

Figure 12:
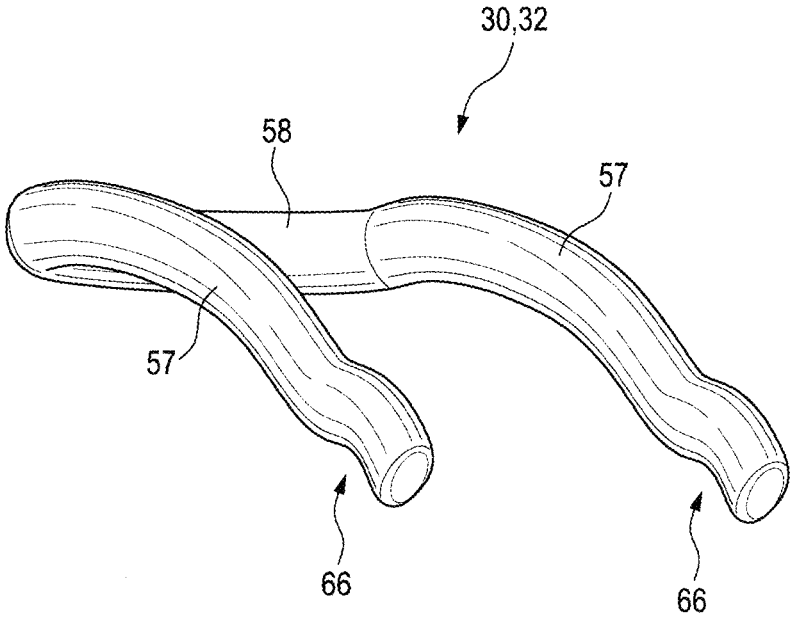
FIG. 12 is a perspective view of an embodiment of an actuator of the hair clip.

FIG. 12 shows a perspective view of another embodiment of an actuator of the hair clip.

Similar to the embodiments of FIGS. 9 and 10, the actuator 30, 32 is designed as an insertable actuator. The actuator 30, 32 has two insertable elements 57, which are connected to each other via a bracket 58. The actuator 30, 32 can thus be inserted in the manner described above through receptacles in the base portions of the clamping body of the hair clip.

The pin-like, insertable elements 57 can be S-shaped, as shown in FIG. 12. In particular, the S-shape 66 may be formed on a section of the insertable elements 57 facing away from the bracket 58. The S-shape 66 facilitates fixing of the actuator 30, 32 in the "extended" position, i.e. in the first position, so that the actuator 30, 32 does not change its position during actuation. The S-shape 66 can be realized without any major effort, which makes the actuator 30, 32 particularly easy to manufacture.

Figure 13:
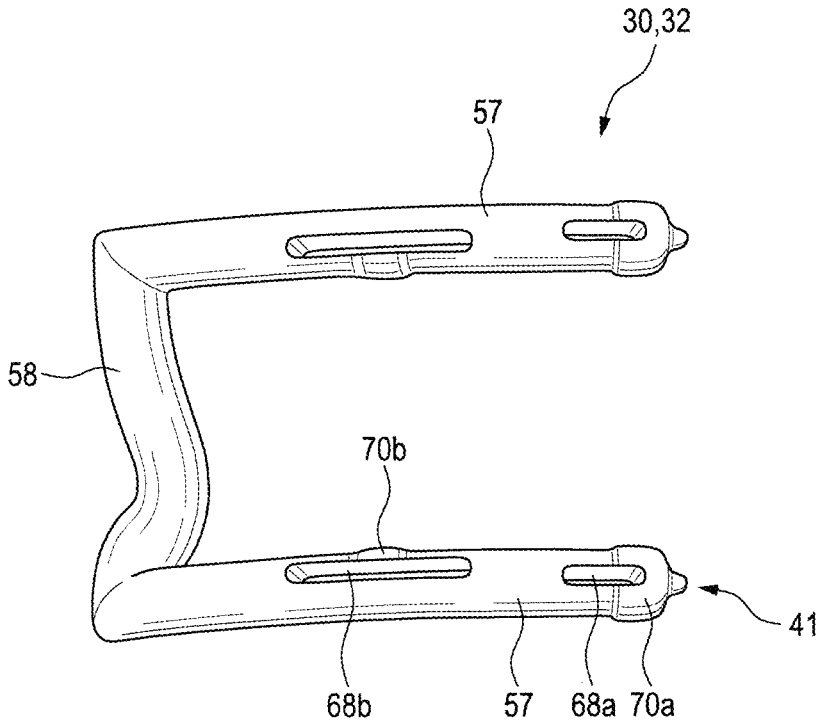
FIG. 13 is a perspective view of another embodiment of an actuator of the hair clip.

FIG. 13 shows a perspective view of an embodiment of another actuator.

As before, the actuator 30, 32 is designed as an insertable bracket, which has two insertable elements 57, which are connected to each other via a bracket 58.

Here, the insertable bracket has a latching mechanism with one or more slots 68*a*, 68*b*, which are recessed in the insertable elements 57. In particular, a first slot 68*a* may be provided at the lower end of the insertable elements 57, i.e. at the end of the insertable elements 57 opposite to the bracket 58. The slot 68*a* allows the material at this end of the insertable element 57 to yield slightly so that the insertable element 57 can be inserted into the receptacle in the base portion. The thickening 70*a* at the same end prevents the insertable bracket from being pulled out too easily and also serves as termination element 41.

An additional slot 68*b* in a middle section of the insertable elements 57 can be used together with a further thickening 70*b* at the middle height of slot 68*b* as a latching element so that the insertable element 30, 32 does not slip into the clip when the actuator 30, 32 is actuated. At the same time, with a little more pressure, the insertable bracket can be easily recessed into the hair.

It goes without saying that the two embodiments for actuators 30, 32 shown above are only to be understood as examples. In particular, the features shown in the above embodiment may be combined in other embodiment. The overall design of the actuators 30, 32 contributes to a simplified handling of the hair clip.

Figure 14:
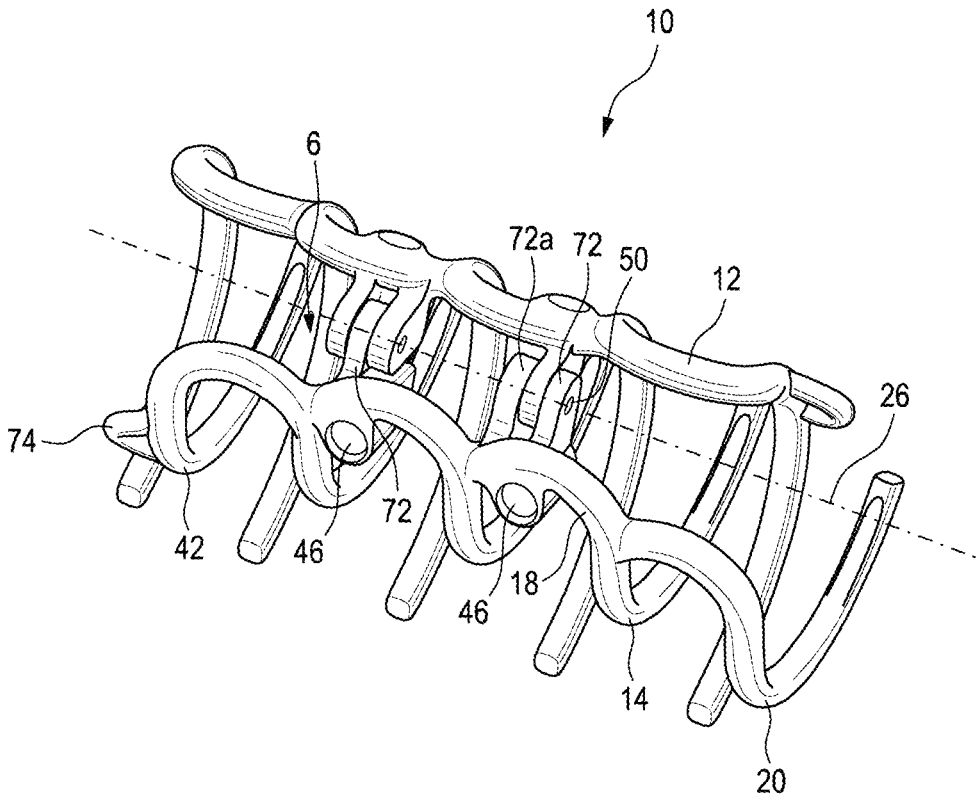
FIG. 14 is a perspective view of an embodiment of the hair clip having two identical clamping bodies.

Finally, FIG. 14 shows a perspective view of an embodiment of a clamping body of the hair clip.

The first clamping body 12 and the second clamping body 14 can be identical. Therefore, the following description only refers to one of the two clamping bodies.

The clamping body 12 is divided into a clamping portion 20 and a base portion 18, as described above. The clamping portion 20 is formed by individual teeth 42, which are held together by the base portion 18. In the base portion 18, hole-shaped receptacles 46 are provided, into which the previously described insertable brackets can be inserted as actuators (not shown here).

The two clamping bodies 12, 14 can be connected to each other via joint portions 6. In the example embodiment, each clamping body may comprises at least three joint bars. A third joint bar 72*a* can prevent the clamping bodies 12, 14 from slipping along an axis of rotation 26 defined by pivot pin 50, which may be similar to or different than the hinge pin 50 of FIG. 6. In addition, the additional joint bar 72*a* increases the stability of the joint advantageously. In particular, the third joint bar 72*a* can be designed somewhat wider than the other joint bars and thus serve as a stable support for the spring legs, which transmit a large force at this point.

Furthermore, as shown in FIG. 14, an outer tooth of the teeth 42 can additionally have a loop 74 which serves as a counter bearing for a tooth of the other clamping body. Thereby, fitting the clip in the hair can be further improved.

It goes without saying that the illustration of the clamping bodies in FIG. 14 is only to be understood as an example and that other configurations are conceivable. In particular, the features of the shown clamping bodies may be combined with the features of the clamping bodies of the previous embodiment.

According to an aspect of this disclosure, there is provided a hair clip comprising: a first clamping body having a first base portion and a first clamping portion, a second clamping body having a second base portion and a second clamping portion, a joint by which the first base portion and the second base portion are coupled to one another along a swivel axis, so that the first clamping portion and the second clamping portion are arranged movable relative to one another about the swivel axis, an elastic element configured to force the first clamping portion and the second clamping portion into a combined position, and a first actuator arranged on said first base portion for moving said first clamping portion relative to said second clamping portion from said combined position into a spread position, said first actuator is arranged on said first base portion movable relative thereto to assume a first position and a second position relative to said first base portion. The hair clip may comprise an element which can be inserted through a correspondingly shaped receptacle in the first base portion. The element can be shaped like a pin.

The phrase at least one of A, B, and C should be construed to mean a logical (A OR B OR C), using a non-exclusive logical OR, and should not be construed to mean "at least one of A, at least one of B, and at least one of C."

What is claimed is:

1. A hair clip, comprising:

a first clamping body having a first base portion and a first clamping portion;

a second clamping body having a second base portion and a second clamping portion;

a joint by which the first base portion and the second base portion are coupled to one another along a swivel axis, so that the first clamping portion and the second clamping portion are arranged movable relative to one another about the swivel axis;

an elastic element configured to force the first clamping portion and the second clamping portion into a combined position; and a first actuator arranged on the first base portion and configured to move the first clamping portion relative to the second clamping portion from the combined position into a spread position, wherein the first base portion further comprises a receptacle configured to receive first actuator so that the first actuator is movable through the receptacle relative to the first base portion from a first position to a second position relative to the first base portion, and wherein when the first actuator is the second position, a portion of the first actuator is configured to be disposed within hair that is clamped between the first clamping portion and the second clamping portion.

2. The hair clip of claim 1, wherein:

the first actuator comprises a first element configured to be inserted through the first base portion and a second element configured to be inserted through the first base portion, and the first element and the second element are connected to each other via a bracket.

3. The hair clip of claim 1, wherein:

the swivel axis and a point on a side of the first clamping portion facing away from the first base portion define a first clamping plane, in the first position, at least a larger part of the first actuator is located on a side of the first clamping plane facing away from the second clamping portion, and in the second position, at least a larger part of the first actuator is located on a side of the first clamping plane facing the second clamping portion.

4. The hair clip of claim 1, wherein the receptacle is configured to guide the first actuator from the first position to the second position.

5. The hair clip of claim 1, wherein the receptacle is formed such that the first actuator can be at least partially inserted through the receptacle to be moved back and forth between the first position and the second position.

6. The hair clip of claim 1, wherein the receptacle is formed from a separate sleeve.

7. The hair clip of claim 1, wherein the first actuator has a first stop that, in the second position, rests on the first base portion.

8. The hair clip of claim 7, wherein the first actuator has a second stop which, in the first position, rests on the first base portion.

9. The hair clip of claim 1, wherein the first actuator is configured to be fixed in a self-retaining manner in the first position.

10. The hair clip of claim 9, wherein the first actuator can be fixed in the self-retaining manner by either one of a notch, a clamping groove, a slot, a thickening, and an S-shaped element.

11. The hair clip of claim 1, wherein the first actuator has a curvature to increase an opening angle between the first clamping portion and the second clamping portion in response to being actuated.

12. The hair clip of claim 1, wherein:

the second clamping body has a second actuator arranged on the second base portion for moving the second clamping portion relative to the first clamping portion, and the second actuator is arranged on the second base portion and movable relative thereto.

13. The hair clip of claim 12, wherein the first clamping body and the second clamping body are formed such that the first actuator and the second actuator do not touch each other in the second position.

14. A hair clip, comprising:

a first clamping body having a first base portion and a first clamping portion;

a second clamping body having a second base portion and a second clamping portion;

a joint coupling the first and second base portions to one another while allowing the first and second clamping portions to move relative to one another about a swivel axis;

an elastic element configured to bias the first and second clamping portions toward one another; and a first actuator arranged on the first base portion and pressable to move the first clamping portion away from the second clamping portion about the swivel axis, wherein the first base portion includes a receptacle configured to receive at least a portion of the first actuator so that the first actuator is translatable relative to the first base portion through the receptacle between a first position and a second position.

15. The hair clip of claim 14, wherein:

the first actuator includes a pin-shaped body and bulbous termination elements disposed at opposite ends of the pin-shaped body to prevent the first actuator from sliding out of the receptacle; and the receptacle is a sleeve disposed in a recess of the first base portion.

16. The hair clip of claim 14, wherein the first actuator includes at least one of a clamping groove, a slot, a thickened section, and an S-shaped portion configured to retain the first actuator in the first position.

17. The hair clip of claim 14, wherein the first actuator includes a pair of pin-shaped bodies and a bracket connecting the pin-shaped bodies to one another.

18. A hair clip, comprising:

a first clamping body having a first base portion and a first clamping portion;

a second clamping body having a second base portion and a second clamping portion;

a joint coupling the first and second base portions to one another while allowing the first and second clamping bodies to move relative to one another about a swivel axis; and a first actuator coupled to the first base portion of the first clamping body, wherein the first actuator is movable relative to the first clamping body between a first position, in which a portion of the first actuator is disposed outside of the hair clip, and a second position, in which a portion of the first actuator is disposed inside of the hair clip between the first and second clamping portions.

19. The hair clip of claim 18, wherein:

the first actuator includes a pin-shaped body and a termination element attached to at least one end of the pin-shaped body; and when the first actuator is in the second position, the termination element is the only portion of the first actuator disposed outside of the hair clip.

20. The hair clip of claim 18, wherein a majority of the first actuator is disposed outside of the hair clip when the first actuator is in the first position, and a majority of the first actuator is disposed inside of the hair clip between the first and second clamping portions when the first actuator is in the second position.

* * * * *